313-422 SR
7/4/78 XR 4,099,085

United States Patent [19]
Endriz et al.
[11] 4,099,085
[45] Jul. 4, 1978

[54] PARALLEL VANE STRUCTURE FOR A FLAT DISPLAY DEVICE

[75] Inventors: John Guiry Endriz, Plainsboro; Jan Aleksander Rajchman; John A. van Raalte, both of Princeton, all of N.J.

[73] Assignee: RCA Corporation, New York, N.Y.

[21] Appl. No.: 672,122

[22] Filed: Mar. 31, 1976

[51] Int. Cl.[2] ..... H01J 29/52; H01J 29/50; H01J 29/46

[52] U.S. Cl. ..... 313/400; 313/105 R; 313/422

[58] Field of Search ..... 313/105 R, 103 SM, 104, 313/103 R, 399, 95, 422, 400

[56] References Cited

U.S. PATENT DOCUMENTS

| | | | |
|---|---|---|---|
| 3,646,382 | 2/1972 | Goede et al. | 313/104 |
| 3,904,923 | 9/1975 | Schwartz | 315/169 TV |
| 4,029,984 | 6/1977 | Endriz | 313/400 |
| 4,034,255 | 7/1977 | Catanese et al. | 313/105 R X |

FOREIGN PATENT DOCUMENTS

| | | | |
|---|---|---|---|
| 2,263,614 | 7/1974 | Fed. Rep. of Germany | 313/103 |

*Primary Examiner*—Robert Segal
*Attorney, Agent, or Firm*—Glenn H. Bruestle; George E. Haas; Dennis H. Irlbeck

[57] ABSTRACT

An evacuated envelope includes a transparent front panel having a cathodoluminescent screen thereupon and a back panel interconnectably sealed to the front panel. The back has a plurality of cathode stripes thereon. A plurality of vanes, spaced from and parallel to each other, extend between the front and back panels orthogonal to the cathode stripes. Electrodes to control the operation of the device are formed directly on the vanes. Any two adjacent vanes form an electron multiplier in which a self sustaining source of electrons is created only at a location along the vanes which is determined by the proper energizing of the cathode stripe at that location.

7 Claims, 4 Drawing Figures

PARALLEL VANE STRUCTURE FOR A FLAT DISPLAY DEVICE

BACKGROUND OF THE INVENTION

This invention relates to flat, large area image display apparatus or devices, such as for displaying television, alphanumeric or other images; and particularly to an internal structure for such display devices of the cathodoluminescent type.

Cathodoluminescent display devices have been suggested wherein the electron source is a multi-dynode electron multiplier operated in a regenerative feedback mode. If such devices are employed as television displays, the structure of the device becomes quite complex because of the large number of elements in the television picture. Size and structure limitations are thereby placed on the multiplier design. In order for such devices to find practical application a less complicated structure is needed.

SUMMARY OF THE INVENTION

An image display device comprises an evacuated envelope having spaced front and back panels. The transparent front panel has a cathodoluminescent screen thereon. A plurality of parallel cathode stripes are on the back panel. A plurality of spaced substantially parallel vanes are substantially orthogonal to the cathode stripes. Each of the vanes has electrodes on it for controlling the operation of the device.

DETAILED DESCRIPTION OF THE INVENTION

Figure 1:
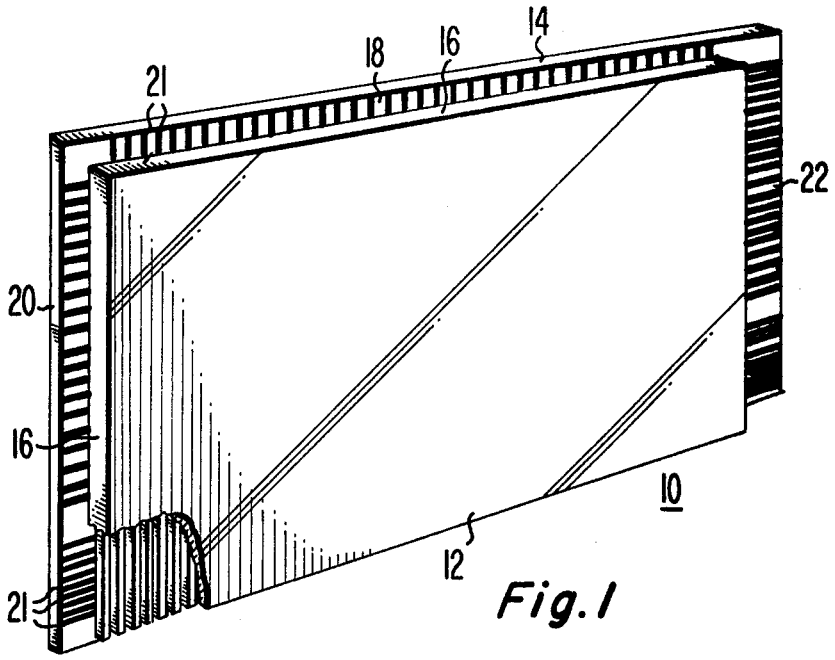
FIG. 1 is a partially cut away perspective view of a flat panel image display device.

With initial reference of FIG. 1, a flat image display device 10 comprises an evacuated glass envelope having a flat transparent viewing front panel 12 and a flat back panel 14. The front and back panels 12 and 14 are parallel and sealed together by peripheral side wall 16. The back panel 14 extends beyond the side walls 16 of the device 10 to form terminal areas 18, 20 and 22. Each of the terminal areas has a plurality of leads 21 which interconnect to internal components for activating and controlling the device. In one embodiment, the overall dimensions of the device 10 may be 84 cm high by 112 cm wide by 3 cm thick. The viewing area of this size device is 76 cm by 102 cm.

Figure 2:
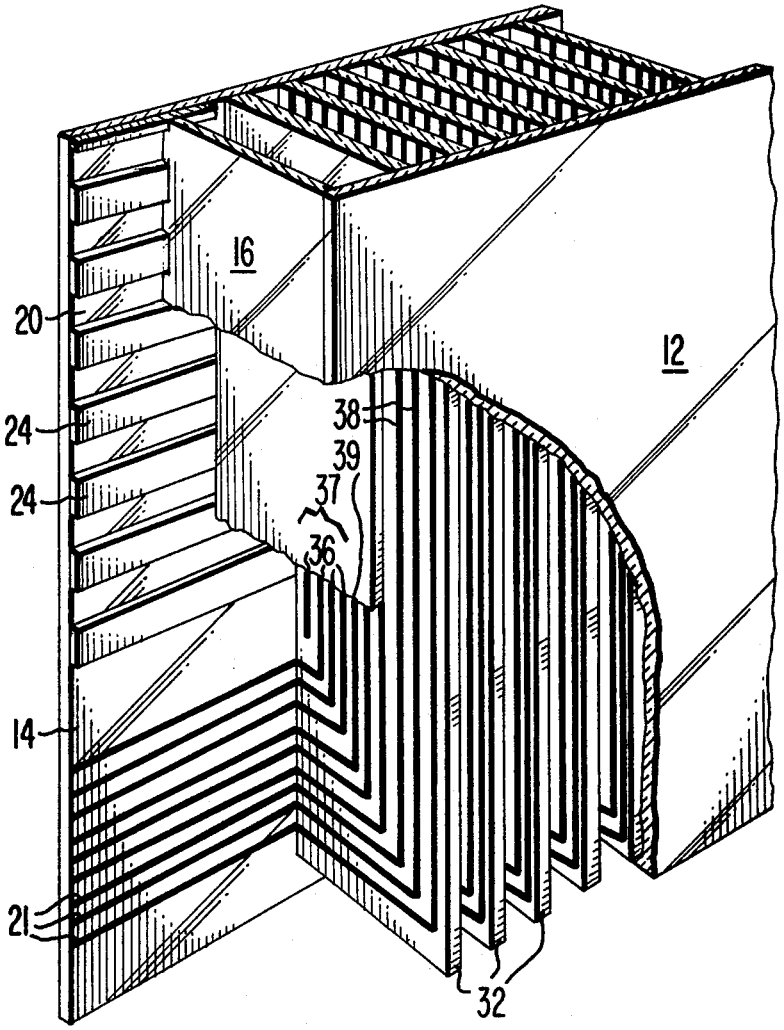
FIG. 2 is an enlargement of the cut away section of FIG. 1.

The internal structure of the device 10 is shown in the cut away view of FIG. 2. The back panel 14 has a plurality of cathode stripes 24 on its inside surface. Each stripe 24 is of a conductive material, such as metal, which may be overcoated with a thin layer of a material that provides a high electron emission under bombardment by a feedback species, such as ions or photons. For ion feedback, the emissive material may be MgO or BeO. The cathode stripes 24 can be coated onto the back panel in the desired pattern by a variety of techniques, e.g., sputtering or evaporation of the component metal followed by photo-etching and oxidation.

A plurality of spaced parallel vanes 32 extend between and are in perpendicular contact with the front and back panels 12 and 14. The vanes 32 are arranged orthogonal to the cathode stripes 24 so that each vane extends across a plurality of the cathode stripes. Intrasupport of the front and back panels 12 and 14 is provided by the vanes 32. This provides a structure having sufficient rigidity to withstand the force of atmospheric pressure when the device is evacuated or partially evacuated. Not every vane 32 need contact the front panel 12 to provide sufficient intrasupport for the device.

Figure 4:
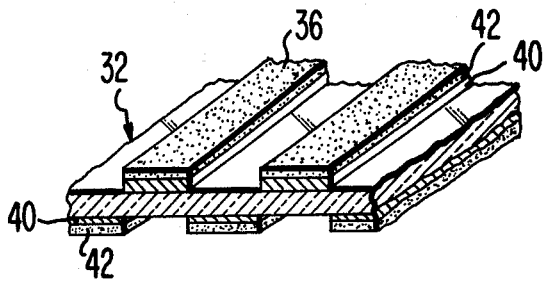
FIG. 4 is a sectional perspective view of a portion of one of the vanes in FIG. 1.

Each of the vanes 32 is formed from flat insulating material, such as glass or ceramic. Each vane 32 is coated on each of its major surfaces with a plurality of electron multiplier dynodes 36 and a plurality of electrodes 38 and 39 for accelerating, modulating, and focusing electron beams. Both the dynodes 36 and the electrodes 38 and 39 may be formed as stripes running orthogonally to and extending across the cathode stripes 24. The dynodes 36 form an electron multiplier 37 between two adjacent vanes. A cross sectional view of a portion of one of the vanes 32 is shown in FIG. 4. A first layer 40, approximately 0.025 millimeters thick, of electrically conductive material is selectively applied to the surface of each vane 32 by masked evaporation, screening or some other method. A second layer 42 of approximately 500 A of secondary electron emitting material, such as MgO, is coated over the first layer 40 by solution spraying, oxidation of evaporated material or some other method. The electrodes 38 and 39 may be formed by merely applying a selected pattern of electrically conductive material to vanes.

Figure 3:
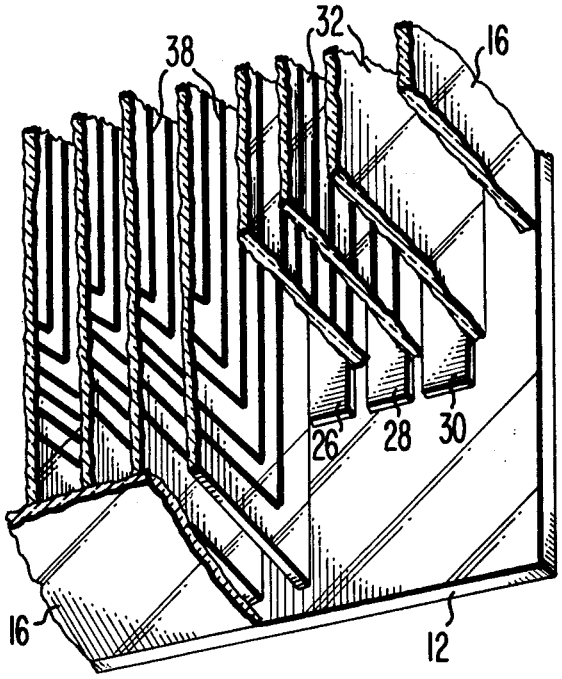
FIG. 3 is a sectional perspective view of a portion of the inside of the front panel of the device of FIG. 1.

The front panel 12 shown in FIG. 3 is preferably of glass and serves as the viewing faceplate of the device 10. The internal surface of the front panel 12 is covered with a plurality of phosphor stripes 26, 28 and 30 capable of emitting light upon electron bombardment. The phosphor stripes are orthogonal to the cathode stripes 24 on the back panel 14. Each phosphor stripe extends parallel to and between each set of adjacent vanes 32. If the device 10 is intended to display a color image, the internal surface of the faceplate 12 may be covered with alternating red, green, and blue light emitting phosphor stripes 26, 28 and 30 respectively.

If the device 10 is to be employed to display a television picture, the number of cathode stripes 24 is related to the number of horizontal scan lines of the television picture. In the U.S., for example, The NTSC standard for television comprises 525 lines. Of these 525 lines, up to 42 lines may be used for blanking. Therefore, a minimum television display under present standards, requires 483 cathode stripes or some multiple thereof for a complete display of video information. Alternatively, an integral fraction of 483 stripes may be used if electron beam deflection in the vertical dimension is utilized. Similarly the device may be constructed with various numbers of cathode stripes to match the television standards of other countries. Regardless of the number of cathode stripes 24, there may be any number of parallel vanes 32. However, from 1900 to 2200 vertical vanes are sufficient to provide adequate resolution in most practical tri-color devices having one color element between each pair of vanes. Alternately, fewer vertical vanes, e.g., 650, may be used if several phosphor stripes e.g., three, are deposited between each pair of vanes and horizontal beam deflection is utilized.

The cathode stripes 24 provide input electrons for the multipliers 37. If the cathode stripe 24 is electrically more negative than the first dynode 36, electrons emitted by the stripe 24 will be attracted to the first dynode. However, if the cathode stripe is more positive than the first dynode, the emitted electrons will not reach the first dynode. Thus the electron flow may be turned on and off in various regions of the multiplier by biasing various cathode stripes 24. Increasing voltages are applied to the multiplier dynodes 36 from the dynode closest to the cathode stripes 24 to the dynode closest to the front panel 12. For example, in the embodiment described herein a dynode to dynode voltage increase of 200 volts permits acceptable multiplier operation. The multiplier is initially fired or started by priming electrons emitted from the cathode which may be caused by cosmic or other external radiation impinging thereon or by other causes. The electron current emitted from a negatively biased cathode stripe 24 is amplified through the very large gain of the multiplier 37.

Under the conditions of an open electron multiplier structure, wherein an unobstructed passage exists from the cathode to the multiplier output as shown in FIG. 2, a large build-up of current can occur. This build-up can be dependent on the fact that a high current in the last stages of the multiplier produces ionization of the residual gas within the envelope of the apparatus 10. Some ionization occurs even in a so-called excellent vacumn, for example $10_{-5}$ Torr (mm Hg). Although the number of ions is small, the positive ions that are produced are accelerated toward the back panel 14 and bombard the cathode stripes 24 which if negative with respect to the first dynode, can release more ion secondary electrons to the multipliers 37 thereby completing a regenerative feedback loop. The gain of the regenerative feedback loop will exceed one if the multiplier gain is sufficiently large. A feedback loop gain of one is defined as the gain necessary to insure that for every electron emitted by the cathode, enough ions will return to strike the cathode to emit another electron. If this gain exceeds one, current build-up occurs and continues until the effect of a saturation mechanism, such as space charge, begins to limit the multiplier output. At this point, there is a sustained current emission.

The multiplier gain can easily be in the millions if a sufficient number of multiplier stages is used leading to a loop gain in excess of one, at interior pressures as low as $10^{-5}$ Torr. For example, if the multiplier has ten stages, and each stage has a gain of four, the total gain of the multiplier would be more than 1 million. Such per stage gains can be attained at relatively low voltages if a high yield secondary emitter such as magnesium oxide is used.

To be useful as a television image display, the location of the multiplier electron output on the front panel must be controlled. If the present device is to be used to display a television image, each cathode stripe 24 can correspond to a line of the display on the front panel 12. The cathode stripes 24 are normally biased positively with respect to the first dynode 36 of each multiplier, so that the emitted electrons cannot reach those dynodes. Therefore, in order to scan a line of video information, a voltage which is more negative than the first dynode voltage, is applied to the corresponding cathode stripe 24. The other cathode stripes are maintained in an off state. This negative bias applies a potential source of electrons to a limited portion of the length of each of the multipliers 37 adjacent to the negatively biased on state cathode stripe 24. Under this condition only electrons from the on-stripe 24 can be multiplied. Thus only the portion of each phosphor stripe which is opposite this cathode stripe will be illuminated. Elements of the line may be scanned by sequentially or simultaneously addressing each of the multipliers 37. On-off control of the various picture elements along the scan line can easily be effected, for example, by changing the voltage on the dynodes 36 of each of the multipliers 37 to values which will or will not support current build-up. Preferably more than one dynode 36 in each multiplier 37 can be controlled to insure complete cutoff of the multiplier.

Gray scale modulation (i.e., a selective gradation of the number of electrons allowed to strike each phosphor stripe on the screen) can be obtained by several means. For example, by regulating the duration of the on-time of the multipliers (e.g., pulse length modulation), the number of electrons striking the phosphor stripes is regulated. Alternatively, the electron flow may be regulated by employing controlling electrodes or modulators 39, placed at the multiplier output on each of the vanes 32. These modulators 39 can be used in several ways to control electron flow. For example, the passage of electrons through an electro-optic modulator lens, formed by electrodes 39, can be space charge limited. Space charge limitation can be considered to be that level of saturation of electron passage wherein no further electrons can fit through the opening of the electro-optic lens. The level of saturation of space charge limitation will depend upon the video signal applied to each modulator. Therefore, the number of electrons permitted to strike various phosphor stripes on the screen can be controlled by varying the voltages applied to the various modulators 39.

Electrons that pass through the modulator 39 are further accelerated toward the screen and focused by the remaining electrodes 38. Acceleration is accomplished by providing increasingly more positive voltages to the electrodes 38 as the front panel 12 is approached. Such voltage distribution is also useful to reduce electrical break-down between electrodes. By suitable design, these same electrodes 38 provide focusing of the electrons into the required electron beam size.

In order to illuminate a particular spot on the front panel screen, a voltage is applied to the particular cathode stripe 24 corresponding to the line in which the picture element is positioned. Next the electron multiplier 37 corresponding to the location of the picture element is turned on by providing a voltage to the dynodes 36 of the multiplier 37 which will support current build-up. The selection of the proper cathode stripe 24 and multiplier 37 is a form of X-Y addressing for the picture element. The electrons emitted from the cathode stripe 24 will be multiplied by the electron multiplier 37; and modulated, focused and accelerated by the particular modulating, focusing and accelerating electrodes 38 and 39 following the electron multiplier. The electron beam thereby formed will impinge upon the particular phosphor stripe 26, 28 or 30 thus illuminating a particular colored picture element.

Although the foregoing embodiment of the flat image display device is shown with particular electrode arrangement therein, the basic structure permits any variations in the electrodes. Different electrode widths, locations and potential distributions easily can be accomplished by variations in the electrode patterns.

The present invention provides a novel structure for a flat, image display device. The support structure has been simplified over prior art devices. By utilizing a plurality of cathode stripes in conjunction with flat electron multipliers the addressing of various elements of the display has been simplified.

We claim:

1. An image display device comprising:

an evacuated envelope including a transparent front panel and a substantially parallel back panel spaced from the front panel, the front panel having a cathodoluminescent screen thereon;

a plurality of substantially parallel cathode stripes on the back panel; and a plurality of spaced substantially parallel vanes extending orthogonally between said panels, at least some of said vanes contacting both panels thereby providing intrasupport for said device, the vanes being substantially orthogonal to the cathode stripes so as to extend across a plurality of the cathode stripes;

each of the vanes having stripe-shaped electron multiplier dynodes and electrodes for controlling the operation of the device thereon, said dynodes and electrodes being parallel to the back plate and extending orthogonally to the cathode stripes.

2. The device as defined in claim 2 wherein the vanes are formed of an electrically insulative material selected from the group consisting of glass and ceramic.

3. The device as in claim 1 wherein the cathodoluminescent screen comprises a plurality of phosphor stripes, at least one stripe being between two vanes.

4. An image display device comprising:

an evacuated envelope including a transparent front panel and a substantially parallel back panel spaced from the front panel, the front panel having a cathodoluminescent screen thereon;

a plurality of substantially parallel cathode stripes on the back panel formed of a material which is capable of emitting electrons upon bombardment by feedback species;

a plurality of spaced parallel vanes extending orthogonally between said panels, at least some of said vanes contacting both panels thereby providing intrasupport for said device, said vanes being substantially orthogonal to the cathode stripes so as to extend across a plurality of the cathode stripes;

a plurality of multidynode electron multipliers adjacent to said cathode stripes each multiplier having an open structure and a sufficiently large gain to allow regenerative feedback of species from the multiplier output to the cathode stripes and sustained current emission, the dynodes of each multiplier being located on opposing faces of adjacent vanes, each dynode being a stripe extending orthogonal to said cathode stripes; and means for modulating, accelerating and focusing the electron emission into a beam, the means being between the multiplier and the front panel.

5. The device as in claim 4 wherein the feedback species are ions and wherein the cathode material is capable of electron emission upon ion bombardment.

6. The device as in claim 4 wherein the means for modulating, accelerating and focusing an electron beam comprises a plurality of electrically conductive stripes on each vane, each stripe being parallel to the back panel.

7. The device as in claim 4 wherein the cathodoluminescent screen comprises a plurality of phosphor stripes at least one stripe being between two vanes.

* * * * *